US006768801B1

(12) United States Patent
Wagner et al.

(10) Patent No.: US 6,768,801 B1
(45) Date of Patent: Jul. 27, 2004

(54) HEARING AID HAVING IMPROVED SPEECH INTELLIGIBILITY DUE TO FREQUENCY-SELECTIVE SIGNAL PROCESSING, AND METHOD FOR OPERATING SAME

(75) Inventors: Frank Wagner, Nuremberg (DE); Fred Zoels, Altenthann (DE)

(73) Assignee: Siemens Aktiengesellschaft, Münich (DE)

( * ) Notice: Subject to any disclaimer, the term of this patent is extended or adjusted under 35 U.S.C. 154(b) by 0 days.

(21) Appl. No.: 09/744,517

(22) PCT Filed: Jul. 12, 1999

(86) PCT No.: PCT/EP99/04884

§ 371 (c)(1),
(2), (4) Date: Mar. 12, 2001

(87) PCT Pub. No.: WO00/05923

PCT Pub. Date: Feb. 3, 2000

(30) Foreign Application Priority Data

Jul. 24, 1998 (DE) ..... 198 33 434

(51) Int. Cl.[7] ..... H04R 25/00
(52) U.S. Cl. ..... 381/312; 381/320; 381/321
(58) Field of Search ..... 381/312, 317, 381/320, 321, 73.1, 94.1, 94.2, 94.3, 104, 106, 316

(56) References Cited

U.S. PATENT DOCUMENTS

| | | | | |
|---|---|---|---|---|
| 4,366,349 A | | 12/1982 | Adelman | |
| 4,390,756 A | | 6/1983 | Hoffmann et al. | |
| 4,803,732 A | | 2/1989 | Dillon | |
| 4,852,175 A | | 7/1989 | Kates | |
| 5,046,102 A | | 9/1991 | Zwicker et al. | |
| 5,475,759 A | | 12/1995 | Engebretson | |
| 5,600,728 A | | 2/1997 | Satre | |
| 6,198,830 B1 | * | 3/2001 | Holube et al. | 381/321 |

FOREIGN PATENT DOCUMENTS

| | | |
|---|---|---|
| DE | OS 31 51 352 | 9/1992 |
| DE | PS 38 02 903 | 9/1993 |
| DE | OS 43 40 817 | 6/1995 |
| FR | 0 577 441 | 1/1994 |
| WO | WO 91/03042 | 3/1991 |

* cited by examiner

*Primary Examiner*—Huyen Le
(74) *Attorney, Agent, or Firm*—Schiff Hardin LLP

(57) ABSTRACT

In a hearing aid having a microphone and an earphone with a signal processing unit connected therebetween, and a method for operating such a hearing aid, a filter element in the signal processing unit splits the signal from the microphone into a number of partial signals, and each of the partial signals is analyzed, to determine whether they respectively contain speech information, by comparing the magnitude of the envelope of the partial signal to the average value of the partial signal. For any partial signal having an envelope magnitude which exceeds the average value, the analysis unit operates an amplification stage to amplify that partial signal before it proceeds to the earphone.

9 Claims, 1 Drawing Sheet

HEARING AID HAVING IMPROVED SPEECH INTELLIGIBILITY DUE TO FREQUENCY-SELECTIVE SIGNAL PROCESSING, AND METHOD FOR OPERATING SAME

BACKGROUND OF THE INVENTION

1. Field of the Invention

The present invention is directed to a hearing aid as well as to a method for operating a hearing aid.

2. Description of the Prior Art

Hearing aids that can be worn at the head are known that include specific hearing programs for the suppression of disturbing noise, whereby particular frequency portions can be attenuated by the activation of a filter. In this way, an improvement in general situations of disturbing noise can be achieved that is however insufficient for many cases of use.

From EP 577 441 A2, a hearing aid is known having at least one input transducer of a signal processing unit and one output transducer. The signal processing unit comprises at its input an A/D converter, a plurality of parallel signal channels each having a filter, an analysis element, and a matching element, and, at the output, a D/A converter. The signal processing unit thereby enables the recognition and boosting of speech signals. The signal analysis is based on measurements of the amplitude, the frequency, the duration, and the changes in frequency of a signal.

From U.S. Pat. No. 5,046,102, a hearing aid is known in which an arrangement of a plurality of frequency selection channels is connected between a microphone and an earpiece. In addition, this hearing aid comprises a means for measuring the strength of a signal in each individual frequency selection channel and for influencing the channels among one another, in the sense of the suppression of weak signal channels to the advantage of strong signal channels.

From WO 91/03042, a method and an apparatus for distinguishing speech and disturbing signals are known. The input signal is thereby divided into a plurality of band-limited partial signals, of which each contains at least two harmonic frequencies of the speech signal. The envelopes of the partial signals and the synchronism between the envelopes are determined. The further processing of the partial signals takes place dependent on the value of the determined synchronism. A disadvantage of this method is the high computing expense connected therewith.

From U.S. Pat. No. 4,852,175, a multichannel hearing aid is known in which the individual channels can be examined independently of one another for the presence of disturbing sound. If disturbing sound is detected in a channel, a reduction of the gain for this channel takes place. The degree of disturbing sound in a channel is determined on the basis of an amplitude histogram.

SUMMARY OF THE INVENTION

An object of the present invention is to provide a hearing aid, such as a hearing aid that can be worn at the head or a hearing aid that can be implanted, as well as a method for operating a hearing aid, which enable an improvement in the intelligibility of speech in a large number of hearing situations.

The above object is achieved in accordance with the principles of the present invention in a hearing aid, and a method for operating a hearing aid, wherein a filter element in the signal processing unit splits the incoming signal, received by a microphone, into a number of partial signals and wherein, using at least one analysis element, speech information is detected in the partial signals, and wherein, using at least one matching element, the partial signals containing speech information are boosted (amplified), and wherein, for the analysis of the partial signals, the average values thereof and the envelope thereof are identified, and the amplification of the respective partial signal takes place only if the magnitude of its envelope exceeds its average value.

The inventive hearing aid has an analysis element for the detection of speech information in the partial signals split off by the filter element of the hearing aid. The mean value and the curve of the envelopes is thereby determined in the partial signals.

When level peaks occur, the magnitude of the envelopes exceeds the magnitude of the mean value. An excess of this sort can be used as a criterion for the presence of a level peak, so that by this means the presence of speech information becomes detectable in the analysis of the partial signal. The relevant partial signal can thereupon be boosted in order to amplify the detected speech information in relation to low-level disturbing noise.

In contrast to the prior art, in the method and hearing aid according to the invention, an entire frequency range, wherein there is "only" a high probability of the presence of speech information, does not take place, but instead the individual partial signals are analyzed first and are checked for the presence of speech information. Only in the case in which speech information is actually present are the respective partial signals boosted, thereby amplifying the speech information in the present partial signal in relation to the (non-boosted) disturbing noises in further partial signals.

In an advantageous specific embodiment of the hearing aid, the partial signals are produced by splitting into respective frequency ranges that are as small as possible. The smaller the frequency range of the partial signals, the more precisely speech information can be separated from disturbing noises, and the more precisely an isolated and well-directed boosting of detected items of speech information can take place, whereby the speech intelligibility can be significantly improved.

Given a splitting of the overall signal into narrow frequency band, a boosting of the respective partial signal, given the detection of speech, can also take place within a brief response/decay time.

The analysis element advantageously includes a plurality of analysis programs for the detection of various items of speech information and speech patterns. For example, an analysis program can be used for the detection of sudden level peaks (bursts).

Such level peaks are often items of speech information whose level height exceeds the constant low-level disturbing noise.

Additional analysis programs can relate to the detection of particular individual elements of speech, for example, vowels, sibilants, or consonants, whereby precisely these speech elements can be detected and purposively boosted in order to achieve a significant improvement in speech intelligibility. This can be of great importance particularly in the case of hearing-impaired children, because these children often experience great difficulties in learning language due to unheard consonants and sibilants.

In general, the inventive hearing aid makes it possible to detect and to boost purposively items of speech information that are arbitrarily brief and that occur only at isolated points. At the same time, the control procedure is terminated as soon as the analysis element has determined that speech information is no longer present. In this way, the boosting of disturbing noise that occurs again after the speech information is avoided.

In the inventive method, there first takes place an analysis for the detection of items of speech information in the partial signals obtained by splitting the overall signal in a filter element. Given the presence of speech information, the respective partial signal is boosted, thereby improving the speech intelligibility of the detected speech information. In an advantageous variant of the method, speech information in the partial signals is determined by an acquisition of level peaks (bursts). Given the occurrence of such level peaks, there is a high probability of the presence of speech information, which can be delimited from low-level disturbing noise (e.g., background noise).

In further variants of the method, the signal curve of the respective partial signal can be analyzed using mathematical methods and characteristic values, in the manner of a curve discussion.

In a particularly advantageous variant of the method, for a reliable detection of level peaks a boosting of the partial signal can take place only if the magnitude of the envelope exceeds the magnitude of the mean value of the partial signal by a minimum value that can be set, in order to avoid a boosting of the partial signal in case of smaller level fluctuations.

Besides the signal curve analysis of the partial signal ("curve attributes"; i.e., determination of minima, maxima, and pole points, for example), using mathematical methods and characteristic numbers it is also possible to determine auditory parameters (for example, depth of modulation, modulation frequency, etc.) for the analysis of the partial signal, in order to detect particular items of speech information and speech patterns and to boost the partial signal by a correspondingly suitable amount, in accordance with the determined type of speech information or type of speech pattern.

The inventive analysis of the partial signals can take place in arbitrarily short time intervals, in order also to detect speech elements that occur only briefly (for example, vowels, sibilants, consonants, etc.), and to boost them with practically immediate effect and with only small response/decay times for the improvement of speech intelligibility. In an extreme case, in a spoken word only a single letter that agrees with a particular speech pattern can be particularly emphasized, while the other letters and syllables are transmitted unamplified or with slight amplification.

The inventive method thus enables a momentary improvement of speech intelligibility. The inventive controlling and regulation starts within very brief response times (less than two milliseconds) and is switched off within similarly brief decay times if no further speech is detected.

DESCRIPTION OF THE PREFERRED EMBODIMENTS

Figure 1:
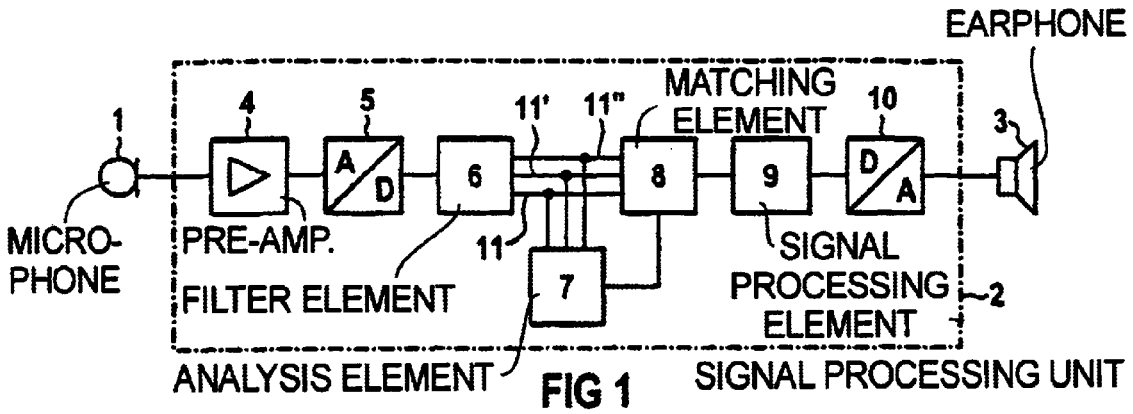
FIG. 1 shows a schematic switching diagram of an inventive hearing aid.

In the hearing aid according to FIG. 1, the signal, recorded by the microphone 1, runs through the signal processing unit 2 to the earphone 3. In the signal processing unit 2 there are located a preamplifier 4, an A/D converter 5, and a filter element 6 for splitting the overall signal into a plurality of partial signals 12, in the present case into the three channels 11, 11', 11". In the analysis element 7, the partial signals of the individual channels 11, 11', 11" are checked for the presence of speech. If a detection of speech takes place, the respective partial signal 12 is boosted (amplified) in the matching element 8, via the connection between the analysis element 7 and the matching apparatus 8, in order to improve speech intelligibility. In the signal processing element 9, the partially boosted partial signals are further processed (for example, using AGC circuits). After a joining of the partial signals 12 and a D/A conversion in the D/A converter 10, the overall signal is supplied to the earpiece 3 with improved speech intelligibility.

Figure 2:
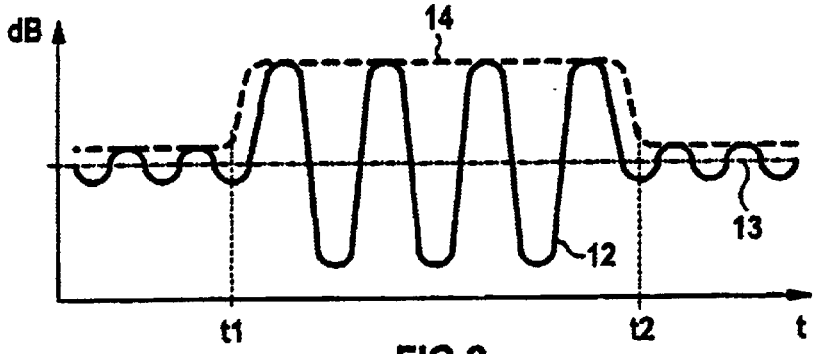
FIG. 2 shows an analysis of the partial signal.

FIG. 2 shows a partial signal 12 that has been checked in the analysis element 7 for speech detection, and which has a sudden level increase (burst) between $t_1$ and $t_2$. It is thereby assumed in the analysis element 7 that speech information is present between the times $t_1$ and $t_2$, and that low-level disturbing noise occurs before $t_1$ and after $t_2$.

FIG. 2 is a schematic representation, and for reasons of clarity shows a level increase having a relatively long duration. The inventive method also enables the detection of brief level peaks (not shown).

The curve of the partial signal 12 can now be evaluated in the analysis element 7 using mathematical methods and characteristic values, for example, using the method known from the curve discussion. Minima, maxima, and pole points, as well as first derivatives or higher derivatives, can thereby be calculated, and, based on the results, inferences can be drawn concerning the presence of particular types of speech information or speech patterns (for example, vowels, sibilants, consonants, etc.).

The analysis of the partial signal 12 of the respective channel 11, 11', 11" is used for the detection of speech, since the inventive boosting of the respective partial signal 12 in the relevant analysis time interval is to take place only given the presence of speech information, in order to avoid a disturbing level from also being boosted.

In FIG. 2, for the analysis of the curve of the partial signal 12 in the analysis element 7, the mean value 13 and the (schematically shown) envelope 14 of the partial signal 12 are shown.

Figure 3:
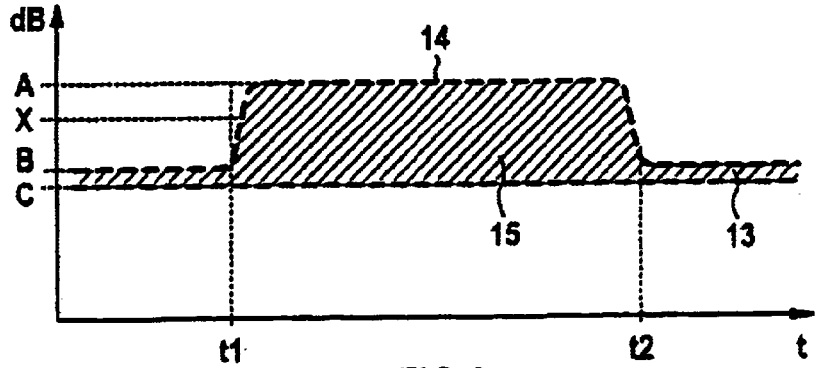
FIG. 3 shows a supplemented detail of FIG. 2.

In FIG. 3, for reasons of clarity the curve of the partial signal 12 has been removed, so that the curve of the magnitude of the envelope 14 and of the mean value 13 can be seen more clearly.

Before $t_1$ and after $t_2$, the envelope 14 reaches the value B, which exceeds the value C of the mean value 13 only slightly. Between $t_1$ and $t_2$, the magnitude of the envelope 14 increases to the value A, whereby the region of overlap 15 between the envelope 14 and the mean value 13 becomes larger. It is thereby to be assumed that the value A is greater than a boundary value X that lies between the value B and the value A.

Due to the fact that the value A of the envelope 14 exceeds the boundary value X, speech is detected between the times $t_1$ and $t_2$, and in this time interval the partial signal 12 is boosted in order to improve speech intelligibility.

The boosting begins after $t_1$, with a response time that is as short as possible—less than 2 ms—and is terminated after $t_2$ with a decay time that is as short as possible, likewise less than 2 ms.

The inventive method thus reacts quickly and spontaneously to the speech information present between the times $t_1$ and $t_2$ in the partial signal 12, and correspondingly boosts the partial signal 12 between the times $t_1$ and $t_2$.

For reasons of clarity, in FIGS. 2 and 3 a distinct spacing is provided between the times $t_1$ and $t_2$. Given brief level peaks, the level increase (at $t_1$) and level decrease (at $t_2$) can also follow one another in rapid succession, whereby, due to the particularly small response/decay times of the inventive method, a practically delay-free boosting and lowering of the partial signal 12 is achieved (not shown).

Although modifications and changes may be suggested by those skilled in the art, it is the intention of the inventors to embody within the patent warranted hereon all changes and modifications as reasonably and properly come within the scope of their contribution to the art.

What is claimed is:

1. A method for operating a hearing aid having a microphone and an earphone with a signal processing unit connected therebetween containing a filter element, comprising the steps of:

in said filter element, splitting an output signal from said microphone into a plurality of partial signals respectively in a plurality of frequency ranges;

analyzing each of said partial signals to identify whether the respective partial signals contain speech information solely by, for each of said partial signals, determining a mean value of the partial signal and an envelope of the partial signal and identifying a partial signal as containing speech information if a magnitude of the envelope thereof exceeds the mean value thereof; and for any of said partial signals identified as containing speech information, amplifying that partial signal between said signal processing unit and said earphone to a greater extent than others of said partial signals.

2. A method as claimed in claim 1 comprising amplifying any of said partial signals having a magnitude of the envelope which exceeds the mean value by a predetermined minimum value.

3. A method as claimed in claim 1 wherein each of said partial signals has a signal curve, and comprising analyzing each of said partial signals by analyzing the respective signal curves thereof.

4. A method as claimed in claim 3 comprising analyzing the respective signal curves of the partial signals by identifying at least a first derivative of the signal curve.

5. A method as claimed in claim 3 comprising analyzing the respective signal curves of the partial signal curves of the partial signals by identifying properties of the signal curve selected from the group consisting of minima, maxima, pole points and null points.

6. A method as claimed in claim 1 comprising analyzing said partial signals by identifying at least one parameter selected from the group consisting of modulation depth, modulation frequency, and auditory parameters.

7. A method as claimed in claim 1 comprising analyzing the partial signals in respective time intervals.

8. A method as claimed in claim 1 comprising amplifying the respective partial signals within response and decay times having a maximum of two milliseconds.

9. A hearing aid comprising:

a signal processing unit connected between said microphone and said earphone, said signal processing unit containing a filter element which splits said microphone output signal into a plurality of partial signals in respective frequency ranges;

an analysis element connected to said signal processing unit for analyzing the respective partial signals by determining for each of said partial signal, an envelope of the partial signals and a mean value of the partial signal and for comparing a magnitude of the envelope of the partial signal to the mean value of the partial signal and identifying any partial signal having a magnitude of the envelope that exceed the mean value as containing speech information; and an amplification stage connected between said signal processing unit and said earphone, and connected to said analysis unit, for amplifying any of said partial signals identified as containing speech information to a greater extent than others of said partial signals.

* * * * *